US006324725B1

(12) United States Patent
Green

(10) Patent No.: US 6,324,725 B1
(45) Date of Patent: Dec. 4, 2001

(54) FURNITURE GLIDE

(76) Inventor: Richard B. Green, 13224 Sand Grouse Ct., Palm Beach Gardens, FL (US) 33418

( * ) Notice: Subject to any disclaimer, the term of this patent is extended or adjusted under 35 U.S.C. 154(b) by 0 days.

(21) Appl. No.: 09/437,563

(22) Filed: Nov. 10, 1999

(51) Int. Cl.[7] ..... A47B 91/00
(52) U.S. Cl. ..... 16/42 R; 16/42 T; 248/188.9
(58) Field of Search ..... 16/42 R, 42 T; 248/188.9, 188.4; D17/99; D6/495, 491; D8/374, 376

(56) References Cited

U.S. PATENT DOCUMENTS

| | | | | |
|---|---|---|---|---|
| 2,836,843 | * | 6/1958 | Gallagher, Jr. | 16/42 R |
| 2,878,509 | * | 3/1959 | Fisher | 16/42 R |
| 2,902,794 | * | 9/1959 | Ehrgott | 248/188.9 |
| 2,919,514 | * | 1/1960 | King et al. | 248/188.9 |
| 2,968,116 | * | 1/1961 | Arenson | 16/42 R |
| 3,213,963 | * | 10/1965 | Vogt | 248/188.9 |
| 3,326,508 | * | 6/1967 | Born | 16/42 R |
| 3,333,805 | * | 8/1967 | Marshall | 248/188.9 |
| 3,505,742 | * | 4/1970 | Leitner et al. | 16/42 R |
| 3,641,620 | | 2/1972 | Hage . | |
| 3,646,633 | | 3/1972 | Meinhardt . | |
| 4,327,461 | | 5/1982 | Wisniewski . | |
| 4,798,359 | | 1/1989 | Ball . | |
| 5,010,621 | | 4/1991 | Bock . | |
| 5,170,972 | | 12/1992 | Casals Guell . | |
| 5,191,676 | * | 3/1993 | Gerner | 16/42 R |
| 5,220,705 | | 6/1993 | Bushey . | |
| 5,287,595 | | 2/1994 | Stevens, Jr. . | |
| 5,426,818 | | 6/1995 | Bushev . | |
| 5,465,430 | | 11/1995 | Davis et al. . | |
| 5,557,824 | | 9/1996 | Bushey . | |
| 5,680,673 | | 10/1997 | Beshore . | |
| 5,820,217 | | 10/1998 | Horner et al. . | |

* cited by examiner

*Primary Examiner*—Chuck Y. Mah
(74) *Attorney, Agent, or Firm*—James H. Beusse; Beusse, Brownlee, Bowdoin & Wolter, P.A.

(57) ABSTRACT

A furniture glide including a stippled bottom surface. A replacement furniture glide may be formed as a cap to be snapped over the existing glide and having a stippled bottom surface. The stipples allow debris on a floor to pass under the glide without becoming embedded in the contact surface between the glide and the floor, thereby preventing the glide from scratching or marring the floor surface. A method of repairing furniture includes installing a cap over the existing furniture glide, with the cap having a stippled bottom surface, or alternatively, installing a replacement glide having a stippled bottom surface.

5 Claims, 1 Drawing Sheet

FURNITURE GLIDE

BACKGROUND OF THE INVENTION

This invention relates generally to the field of furniture, and more particularly to the field of furniture glides, and specifically to a furniture glide cap having stipples.

It is well known to provide a glide at a bottommost portion of a furniture leg to facilitate the sliding movement of the furniture across a floor. Glides are known to take a variety of forms, but may typically include an upper portion adapted to be attached to the leg of a piece of furniture and a lower portion having a smooth, low friction bottom surface for contacting the floor. A common application of such a glide is in school furniture, wherein a tubular shaped metal upper portion of the glide is attached to a tubular metal furniture leg by a friction fit, and a generally flat nylon or polyethelene lower portion is attached to the upper portion and provides a bottom surface for sliding across a tiled or linoleum floor. U.S. Pat. No. 5,010,621 issued to Bock on Apr. 30, 1991, and U.S. Pat. No. 5,170,972 issued to Guell on Dec. 15, 1992, disclose typical furniture glides as are known in the art.

It is known that debris such as dirt, small stones, and dust may become embedded in the bottom surface of a glide. Such debris is present on most floors, and it becomes embedded in the relatively soft nylon or polyethelene material of the glide during normal use of the furniture. Once the glide bottom surface entraps such debris, further sliding of the furniture across the floor can result in the scratching or marring of the floor. It is known to replace the glides on furniture when the amount of debris entrapped in the bottom surface of the glide becomes excessive. Such replacement is time consuming and expensive, and it often requires special tooling for the removal of the discarded glide.

BRIEF SUMMARY OF THE INVENTION

Thus, there is a particular need for an improved glide for furniture that is less susceptible to the entrapment of debris on the bottom surface. There is also a need for a simple and inexpensive method for replacing a degraded glide on an article of furniture.

A furniture glide is described herein having an upper portion adapted to be attached to a piece of furniture and a lower portion attached to the upper portion and having a bottom surface for contacting a floor, wherein the bottom surface includes a plurality of stipples. Such stipples may preferably be hemispherical protrusions from the bottom surface of the glide comprising a maximum of 20% of the area of the bottom surface.

A method of repairing an article of furniture having a glide is also disclosed herein, the method including the steps of: forming a cap having a bottom surface comprising stipples and an inner surface opposed the bottom surface, and attaching the cap to the glide so that the inner surface of the cap contacts the bottom surface of the glide.

BRIEF DESCRIPTION OF THE DRAWINGS

The features and advantages of the present invention will become apparent from the following detailed description of the invention when read with the accompanying drawings in which.

Like structures illustrated in more than one Figure are identified with the same numeral in all Figures.

DETAIL DESCRIPTION OF THE INVENTION

Figure 1:
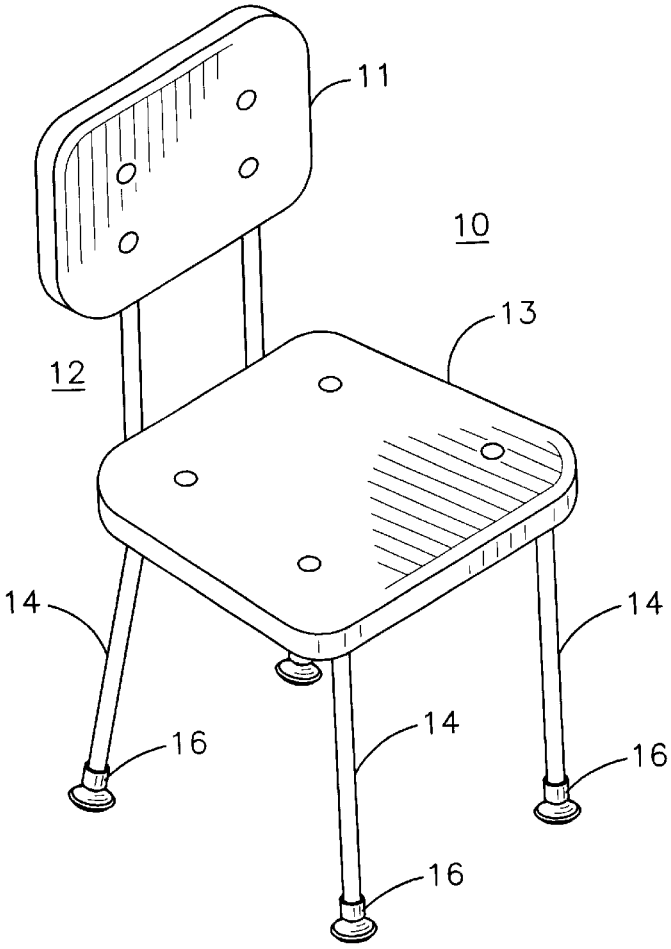
FIG. 1 is a perspective illustration of a chair having a glide in accordance with this invention.

FIG. 1 illustrates an article of furniture, specifically a chair 10, having an improved glide. The chair 10 includes an upper portion 12 consisting of the back 11 and seat 13. A plurality of the legs 14 are attached to the upper portion 12. A glide 16 is attached to the bottom of each leg 14. As can be seen more clearly in FIG. 2, glide 16 includes an upper portion 18 adapted to be attached to the chair leg 14, and a lower portion 20 attached to the upper portion and having a bottom surface 22 for contacting the floor. The bottom surface 22 includes a plurality of stipples 24. Stipples 24 are illustrated as being hemispherical protrusions from the bottom surface 22, although they may take other geometric shapes, for example, cubic, rectilinear, or a pyramid shape. The upper portion 18 of the glide 16 is illustrated as having a generally tubular shape for fitting over the generally tubular shape of the legs 14 of chair 10. Glide 16 may be manufactured from materials known in the art, such as stainless steel for the upper portion 18 and high density polyethelene for the lower portion 20. Advantageously, lower portion 20 may be formed by an injection molding technique, as is known in the art.

Stipples 24 provide a surface for contact with the floor, and they provide a space between adjacent stipples for the collection of debris that may be present on the floor. Prior art glides having a generally flat bottom surface are known to slide over grit on the floor, thereby placing the grit between the bottom surface of the glide and the floor. This causes the grit to become embedded in the relatively soft bottom surface of the glide. By providing a collection area 25 for such debris, the glide 16 of FIG. 2 tends to displace grit present on the floor to the area 25 between the stipples as the chair 10 is slid across the floor. Debris is thus able to pass under the bottom surface 22 without becoming embedded within the bottom surface 22. The curved surface of the hemispherical stipples 24 illustrated also tends to prevent such debris from moving directly under the stipple 24, thereby maintaining a relatively clean surface at the tip 27 of the stipples 24 for contact with the floor. The specific size, shape, and density of stipples 24 may be selected depending upon the material of construction of glide lower portion 20, and depending upon the particular application for the article of furniture. In one application for a chair 10 for use in schools, a high density polyethelene glide lower portion 20 may have stipples 24 comprising a maximum of 30% of the area of the bottom surface 22, and preferably a maximum of 20% of the area of the bottom surface 22. For this embodiment, stipples having a generally hemispherical shape and having a height measured from the bottom surface 22 of no more than 1/16 inch may be used, and preferably having a height measured from the bottom surface 22 of no more than 1/32 inch.

Figure 2:
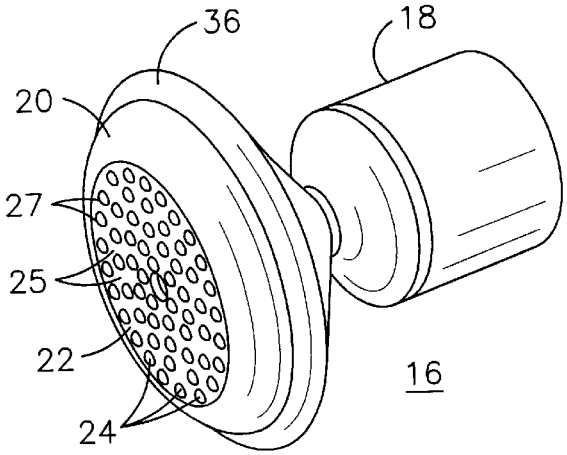
FIG. 2 is a perspective illustration of a furniture glide in accordance with the present invention.
Figure 3:
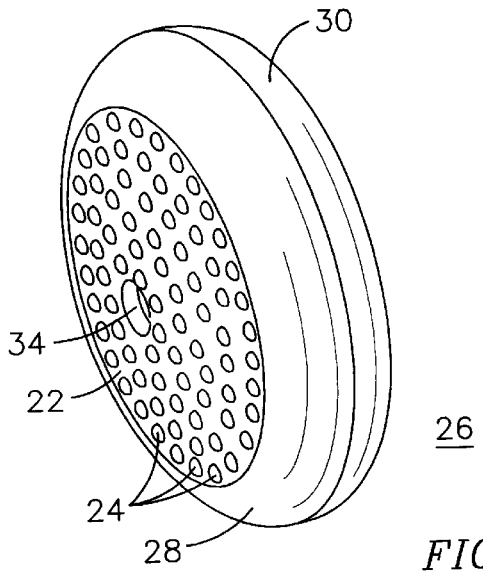
FIG. 3 perspective illustration of a furniture glide cap in accordance with the present invention.

The bottom surface 22 may be a generally planer surface as illustrated in FIG. 2, or it may have a somewhat convex shape as is illustrated in FIG. 3. FIG. 3 illustrates a cap 26 that may function as a glide. The cap 26 has a bottom portion 28 and an upper portion or lip portion 30 attached to the bottom portion 28. A plurality of stipples 24 are attached to, and preferably formed integrally with, the bottom (outside) surface 22. A hole 34 may be formed in bottom portion 28. Cap 26 may be generally hollow with rim 30 defining an opening (not shown) on a top side of the cap 26. The cap 26 may advantageously be used as a replacement glide for the repair of an article of furniture, such as when the existing glide bottom surface becomes embedded with debris. Glide 16 of FIG. 2, as well as prior art glides (not shown), may have a rim portion 36 over which the lip portion 30 of cap 26 may be inserted. An existing glide may be inserted through the opening to come in contact with an inside surface (not shown) of the bottom portion of 28 of cap 26. When the repaired furniture is returned to use, the bottom of the existing glide will rest against and be supported by the inside surface of the cap 26, and the outside surface 22 of the cap 26 with stipples 24 will become the new sliding surface for the furniture.

An article of furniture having a glide for contacting a floor may be repaired by providing a cap 26 having a bottom surface 32, and attaching the cap 26 to the existing furniture glide so that the bottom surface 32 of the cap 26 covers the existing bottom surface of the existing glide. The cap 26 may be formed without the lip portion 30, in which case the bottom portion 28 may be attached to an existing glide by an adhesive or by a mechanical fastener passing through hole 34. In an embodiment where the existing glide has a rim, the cap 26 may be attached by elastically expanding the opening defined by lip 30 and snapping the cap 26 onto the existing glide. Depending upon the tolerances and relative sizes of the existing glide and the opening in the cap 26, it may be advantageous to utilize a specially designed tool to guide the cap 26 onto the existing guide. The cap 26 includes stipples 24 formed in the bottom surface 32. The use of a cap 26 eliminates the necessity of removing the existing guide and thereby greatly simplifies the furniture repair process. However, if the existing glide is defective or for other reasons it is desired to replace the entire glide, the entire existing glide may be removed from the article of furniture, and a replacement glide 16 having stipples 24 on its bottom surface 22 may be installed onto the article of furniture.

A kit may be assembled for repairing an article of furniture. The kit may include one or more of the caps 26 as described above and illustrated in FIG. 3 or it may include one or more glides 16 as described above and illustrated in FIG. 2. The kit may further include appropriate special tooling for the removal of the existing glide and/or the installation of the replacement guide 16 or cap 26. The kit may also include appropriate fasteners or adhesives (not shown) for attaching a cap 26 to the furniture being repaired. In a preferred embodiment, such a kit may include a plurality of caps which may be easily snapped over the existing glide.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim as my invention:

1. A method of repairing an article of furniture having a glide for contacting a floor, the method comprising:

providing a cap having a bottom portion and a lip portion attached to the bottom portion, the bottom portion having an outside surface for contacting a floor, and the lip portion defining an opening;

forming stipples on the outside surface; and inserting the glide through the opening so that the glide is in contact with an inside surface of the bottom portion.

2. A method of repairing an article of furniture having a glide with a bottom surface for contacting a floor, the method comprising:

forming a cap having a bottom surface comprising stipples and an inner surface opposed the bottom surface;

attaching the cap to the glide so that the inner surface of the cap contacts the bottom surface of the glide.

3. A method of repairing an article of furniture having a glide with a bottom surface for contacting a floor, the bottom surface being in a degraded condition, the method comprising:

forming a cap having a bottom surface and an inner surface opposed the bottom surface; and attaching the cap to the glide so that the inner surface of the cap contacts the bottom surface of the glide, the bottom surface of the cap being available for contacting a floor.

4. The method of claim 3, further comprising forming the cap to have a convex bottom surface and a plurality of stipples.

5. The method of claim 3, further comprising forming the cap to have a lip portion defining an opening; and attaching the cap to the glide by expanding the opening and snapping the cap onto the glide.

* * * * *